US008910454B2

(12) United States Patent
Thornton et al.

(10) Patent No.: US 8,910,454 B2
(45) Date of Patent: Dec. 16, 2014

(54) TIMBER STRUCTURAL MEMBER

(75) Inventors: Patrick Thornton, Oak Flats (AU); Peter Blair, Willoughby (AU)

(73) Assignee: Loggo IP Pty. Ltd., New South Wales (AU)

( * ) Notice: Subject to any disclaimer, the term of this patent is extended or adjusted under 35 U.S.C. 154(b) by 180 days.

(21) Appl. No.: 12/845,251

(22) Filed: Jul. 28, 2010

(65) Prior Publication Data

US 2011/0016824 A1 Jan. 27, 2011

Related U.S. Application Data

(63) Continuation-in-part of application No. PCT/AU2009/000082, filed on Jan. 28, 2009.

(30) Foreign Application Priority Data

Feb. 1, 2008 (AU) ..... 2008900435
Apr. 9, 2008 (AU) ..... 2008901730

(51) Int. Cl.

| | |
|---|---|
| ***E04C 3/00*** | (2006.01) |
| ***E04B 1/10*** | (2006.01) |
| ***E04C 3/29*** | (2006.01) |
| ***E04C 3/14*** | (2006.01) |
| ***E04C 3/17*** | (2006.01) |

(52) U.S. Cl.

CPC ... *E04C 3/29* (2013.01); *E04C 3/14* (2013.01); *E04C 3/17* (2013.01); *E04B 1/10* (2013.01)

USPC ..... 52/837; 52/233

(58) Field of Classification Search

CPC ..... E04B 1/10; E04B 1/18; E04B 1/26; E04B 1/2604; E04B 2/70; E04B 2/702; E04B 2/703; E04B 2/708; E04B 2001/264; E04B 2001/2676; E04B 2001/2692; E04C 3/02; E04C 3/12; E04C 3/14; E04C 3/17; E04C 3/29

USPC ..... 52/233, 220.7, 523, 560, 578, 588.1, 52/589.1, 854, 633, 636, 836, 837

See application file for complete search history.

(56) References Cited

U.S. PATENT DOCUMENTS

| | | | | |
|---|---|---|---|---|
| 1,813,455 A * | 7/1931 | Lawton | ..... | 52/233 |
| 2,130,231 A * | 9/1938 | Forciea | ..... | 52/233 |
| 2,416,162 A * | 2/1947 | Drake | ..... | 52/233 |

(Continued)

FOREIGN PATENT DOCUMENTS

| | | |
|---|---|---|
| AT | 385544 B | 4/1988 |
| AU | 144245 S | 6/2001 |

(Continued)

OTHER PUBLICATIONS

Reader's Digest Do-it-Yourself Manual, book 1, Techniques, Published by Reader's Digest Services Pyt. Ltd, Sydney, Second Edition, 1979. pp. 127 and 166.

(Continued)

*Primary Examiner* — Joshua J Michener
*Assistant Examiner* — Theodore Adamos
(74) *Attorney, Agent, or Firm* — Tiajoloff and Kelly LLP

(57) ABSTRACT

A timber joist comprising first and second flanges connected together by a web, the web being structurally integral with the flanges. Both flanges comprise timber poles.

21 Claims, 6 Drawing Sheets

(56) References Cited

U.S. PATENT DOCUMENTS

| | | | | | |
|---|---|---|---|---|---|
| 2,463,612 | A | * | 3/1949 | Grudda | 52/233 |
| 2,619,686 | A | * | 12/1952 | Dombrowski | 52/233 |
| 3,460,301 | A | * | 8/1969 | Davis | 52/233 |
| 3,527,005 | A | * | 9/1970 | Slavens | 52/223.7 |
| 3,802,206 | A | | 4/1974 | Moore et al. | |
| 4,012,876 | A | * | 3/1977 | Grubbs | 52/233 |
| 4,305,238 | A | * | 12/1981 | Harward et al. | 52/233 |
| 4,356,676 | A | * | 11/1982 | Hauptman | 52/396.04 |
| 4,413,459 | A | * | 11/1983 | Lambuth | 52/837 |
| 4,443,990 | A | * | 4/1984 | Johnson | 52/514 |
| 4,463,532 | A | | 8/1984 | Faw | |
| 4,677,806 | A | | 7/1987 | Tuomi | |
| 5,037,234 | A | * | 8/1991 | De Jong | 403/268 |
| 5,058,343 | A | | 10/1991 | Nipko | |
| 5,277,008 | A | * | 1/1994 | Saulez | 52/233 |
| 5,362,545 | A | | 11/1994 | Tingley | |
| 5,456,781 | A | | 10/1995 | Tingley | |
| 5,466,086 | A | * | 11/1995 | Goto | 403/268 |
| 5,498,460 | A | | 3/1996 | Tingley | |
| 5,505,028 | A | * | 4/1996 | Giles | 52/233 |
| 5,547,729 | A | | 8/1996 | Tingley | |
| 5,565,257 | A | | 10/1996 | Tingley | |
| 5,618,371 | A | * | 4/1997 | Sing | 156/264 |
| 5,641,553 | A | | 6/1997 | Tingley | |
| 5,648,138 | A | | 7/1997 | Tingley | |
| 5,721,036 | A | | 2/1998 | Tingley | |
| 5,736,220 | A | | 4/1998 | Tingley | |
| 5,885,685 | A | | 3/1999 | Tingley | |
| 5,910,352 | A | | 6/1999 | Tingley | |
| 5,974,760 | A | | 11/1999 | Tingley | |
| 6,051,301 | A | | 4/2000 | Tingley | |
| 6,173,550 | B1 | | 1/2001 | Tingley | |
| 6,199,332 | B1 | * | 3/2001 | Ellson | 52/233 |
| 6,245,842 | B1 | | 6/2001 | Buxton et al. | |
| D459,488 | S | | 6/2002 | Thornton et al. | |
| D459,493 | S | | 6/2002 | Thornton et al. | |
| D462,788 | S | | 9/2002 | Thornton et al. | |
| D475,144 | S | | 5/2003 | Thornton et al. | |
| 7,797,896 | B2 | * | 9/2010 | Miller et al. | 52/233 |
| 2007/0204538 | A1 | * | 9/2007 | Miller et al. | 52/233 |
| 2009/0293373 | A1 | * | 12/2009 | Klinkhamer et al. | 52/79.9 |

FOREIGN PATENT DOCUMENTS

| | | | |
|---|---|---|---|
| AU | 1444458 | S | 7/2001 |
| AU | 150489 | S | 1/2003 |
| AU | 156224 | S | 8/2004 |
| AU | 158523 | S | 3/2006 |
| DE | 297 17 759 | U1 | 3/1998 |
| EP | 0034224 | A2 | 8/1981 |
| FR | 2556030 | A1 | 6/1985 |
| JP | 8158537 | A | 6/1996 |
| NL | 8701712 | A | 2/1989 |

OTHER PUBLICATIONS

Epoxy Grouted Steel Rods [retrieved on Nov. 30, 2009]. Retrieved from internet: URL: http://www.nzwood.co.nz/how-wood/structural-connections/epoxy-grouted-steel-rods.

Espacenet English Language Abstract for FR 2556030 published on Jun. 7, 1985.

Espacenet English Language Abstract for EP 0034224 published on Aug. 26, 1981.

Espacenet English Language Abstract for JP 8158537 published on Jun. 18, 1996.

Espacenet English Language Abstract for NL 8701712 published on Feb. 16, 1989.

Espacenet English Language Abstract for AT 385 544 B published on Apr. 11, 1988.

* cited by examiner

TIMBER STRUCTURAL MEMBER

RELATED APPLICATIONS

This application is a continuation-in-part of international application PCT/AU2009/000082, which designated the United States of America and was filed on Jan. 28, 2009, and which was published on Aug. 6, 2009 as published PCT application WO 2009/094696 A1, which is herein incorporated by reference.

FIELD OF THE INVENTION

The invention generally relates to the field of structural members for use in building construction. More particularly, but not exclusively, the invention relates to timber structural members for portal frames, which can be incorporated into modular building systems.

BACKGROUND OF THE INVENTION

Timber structural members play an important part in the construction of building structures. Timber is commonly used for joists, beams, columns, rafters and frames because of its strengths for load bearing and its natural ability to withstand a variety of forces. Additionally, compared to metal based materials, timber structural members often cost less to manufacture and are more easily cut and processed for specific building requirements. A strong and useful type of structural member is an "I-joist". The I-joist comprises two flange members with an interconnecting web member, resembling a letter "I" in its cross-section. I-joists have good load bearing and distribution capabilities and are key components in building construction.

The flanges of timber I-joists (hereon called "timber joists") have historically been made from solid wood lumber or laminated timber. In order to obtain flanges of appropriate length and cross-sectional dimensions, relatively large diameter lumber is required. Any imperfection in the flange can greatly compromise the strength of the flange, so relatively high quality lumber is required for the manufacture of timber joists. This has led in turn to increased cost in production as well as raising natural resource conservation issues. Depending on the part of the log it is sawn from, the solid lumber may have issues with natural defects such as splinters, rot, abnormal growth and grain structures. Additionally, when sawn and prepared for commercial use the lumbers are prone to processing defects such as chipping, torn grain and timber wanes.

To address the problems associated with solid wood lumber, alternative forms of wood material for making timber joists have been sought. These include engineered wood composites such as plywood, laminated veneer lumber ("LVL"), oriented strand lumber ("OSL") and oriented strand board ("OSB"). Wood composites have the advantage of being less expensive in raw material cost (as they are able to be formed from lower grade wood or even wood wastes) and do not have the problems associated with solid lumber defects. However, the energy and resource requirements in their manufacture are generally significantly higher as processed structural timber requires significantly more cutting, bonding, and curing than naturally formed timber. Also, timber joists made from wood composites do not have effective end grain connection and when used in building construction they are usually joined by bearing onto another member and nailed to deter sideway twisting and/or movement. This type of connection often requires further mounted metal braces which become design hindrances. Additionally, the metal braces are prone to oxidation and collapse in fire as the metal heats more readily than the timber, resulting in charring of the adjoining timber and loss of support.

Accordingly there is a need for a timber structural member that is manufactured to have superior strength characteristics, requires less processing, has less material wastage, and is easily joined to other structural members without compromising the strength of the member.

Any reference in this specification to the prior art does not constitute, nor should it be considered, an admission that such prior art was widely known or forms part of the common general knowledge in Australia, or in any other jurisdiction, before the priority date of any of the appended claims.

SUMMARY OF THE INVENTION

According to one aspect of the present invention there is provided a timber joist comprising: first and second flanges connected together by a web which is structurally integral with the flanges, both flanges comprising timber poles.

Preferably each flange has a slot formed therein which extends longitudinally along the length of the flange, the slot being dimensional to receive the web, the web being bonded in the slot.

The web may be generally planar and may extend the full length of the flanges. Alternatively, the web may extend beyond the length of the flanges or be shorter than the length of the flanges. The web may comprise one or more segments wherein the flanges include one or more slots and each web segment connects into one of the corresponding slots in the flanges.

The web may be formed of any suitable relatively high tensile strength planar material. Suitable materials include: processed timber such as chipboard, plywood or the like; metal sheet or plate; fibre reinforced cement sheet; plastics or fibre reinforced plastics materials; and the like. The flanges are preferably parallel to each other and the web is preferably of elongate rectangular shape.

One or more ends of the flanges may be configured to form a dowel connection. The dowel connection may comprise of an axial bore in the flange sized to receive a dowel. The dowel will preferably comprise a mild steel or high strength steel rod.

One or more ends of the flanges may be provided with a radial cut shaped and positioned to engage with a further timber pole.

The term "timber pole" as used herein is intended to mean a naturally occurring round cross-section pole having a central core and having had its peripheral surface trimmed so that the pole has a substantially constant cross-sectional shape along its full length. Suitable poles include true round plantation pine, such as slashpine or carribaea hybrids, or other timber species.

According to another aspect of the present invention there is provided a structure comprising a plurality of interconnected structural members, wherein one or more structural members is a timber structural member according to the invention.

In a further aspect the present invention provides a truss comprising at least two timber poles in non-parallel alignment with each other, each pole having a slot therein, and a web bonded into the slots of the two poles to form a structurally integral assembly.

BRIEF DESCRIPTION OF THE DRAWINGS

FIG. 9 shows a front view of a section of a structural member for which the timber joist shown in FIG. 5 may connect to;

DETAILED DESCRIPTION OF THE EMBODIMENTS

Figure 1:
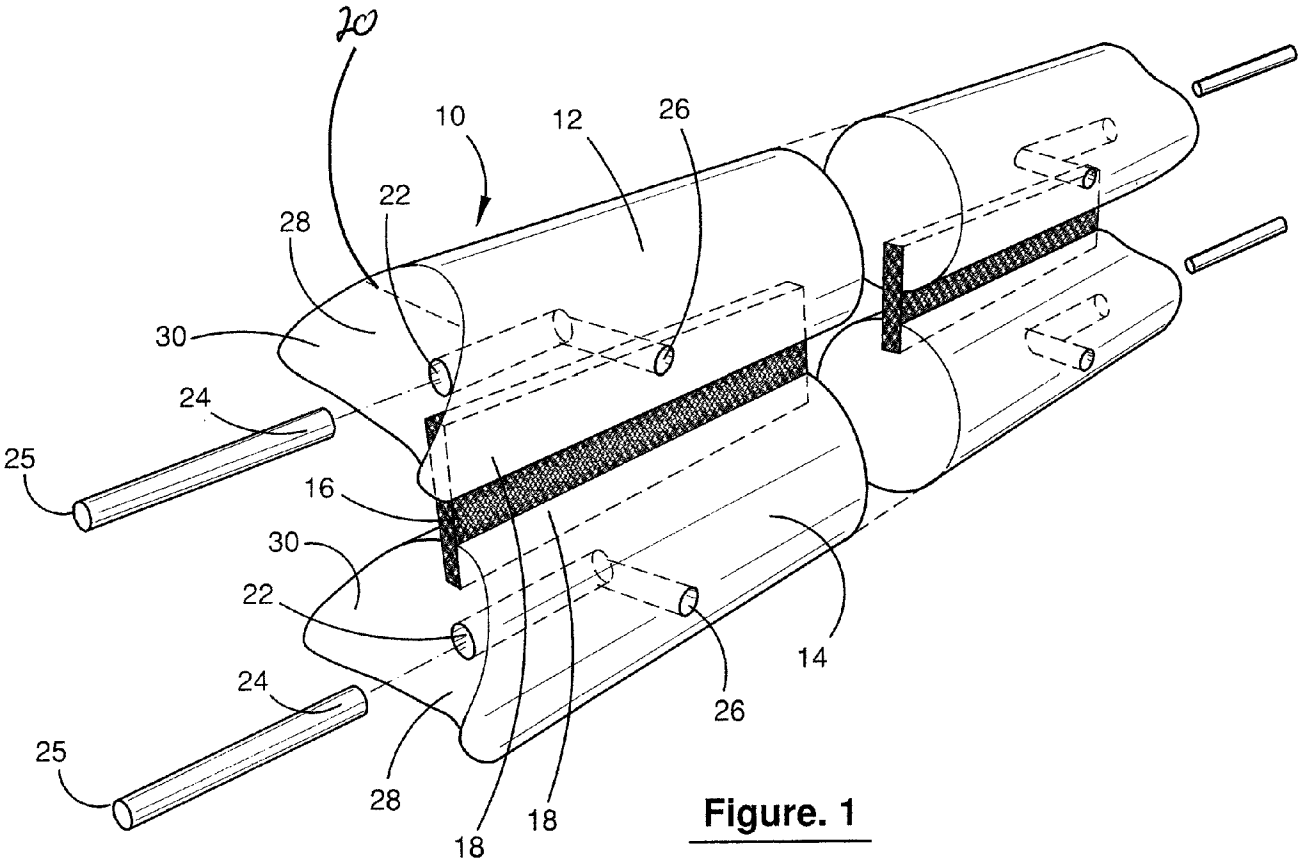
FIG. 1 shows a perspective view of one embodiment of a timber joist in accordance with the present invention.
Figure 2:
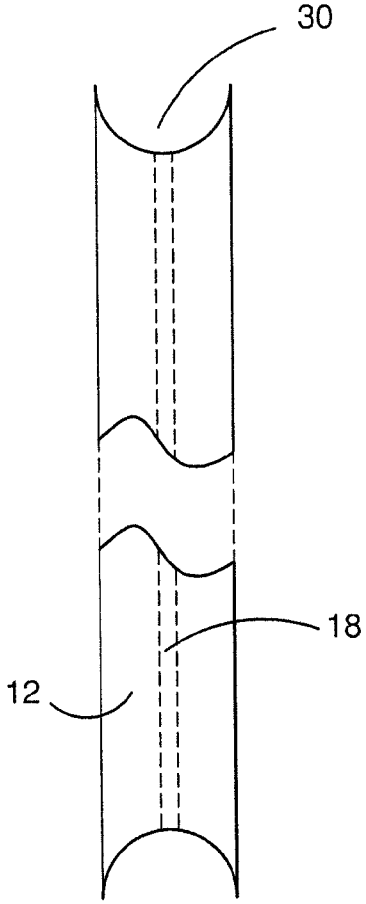
FIG. 2 shows a top view of the timber joist shown in FIG. 1.
Figure 3:
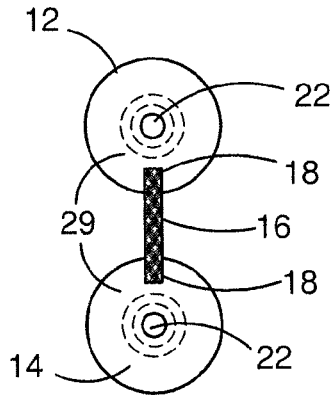
FIG. 3 shows an end view of the timber joist shown in FIG. 1.
Figure 4:
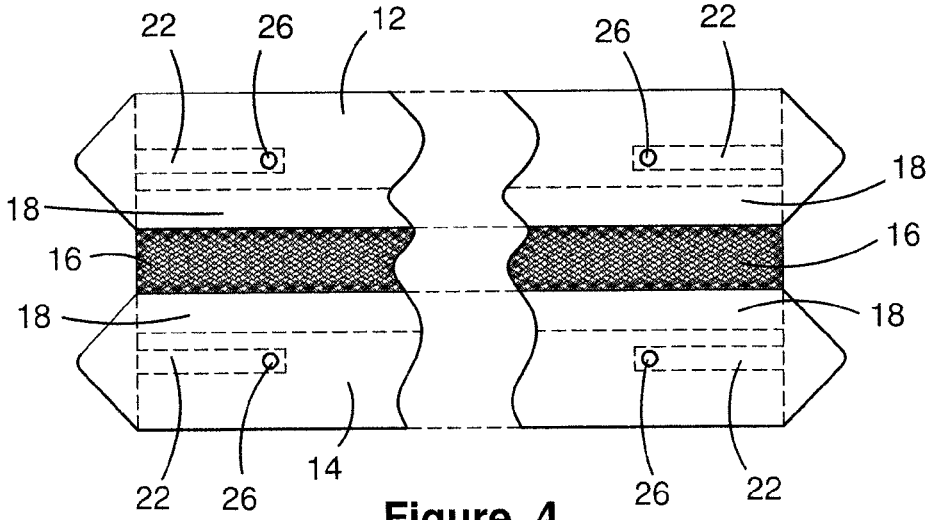
FIG. 4 shows a side view of the timber joist shown in FIG. 1.
Figure 5:
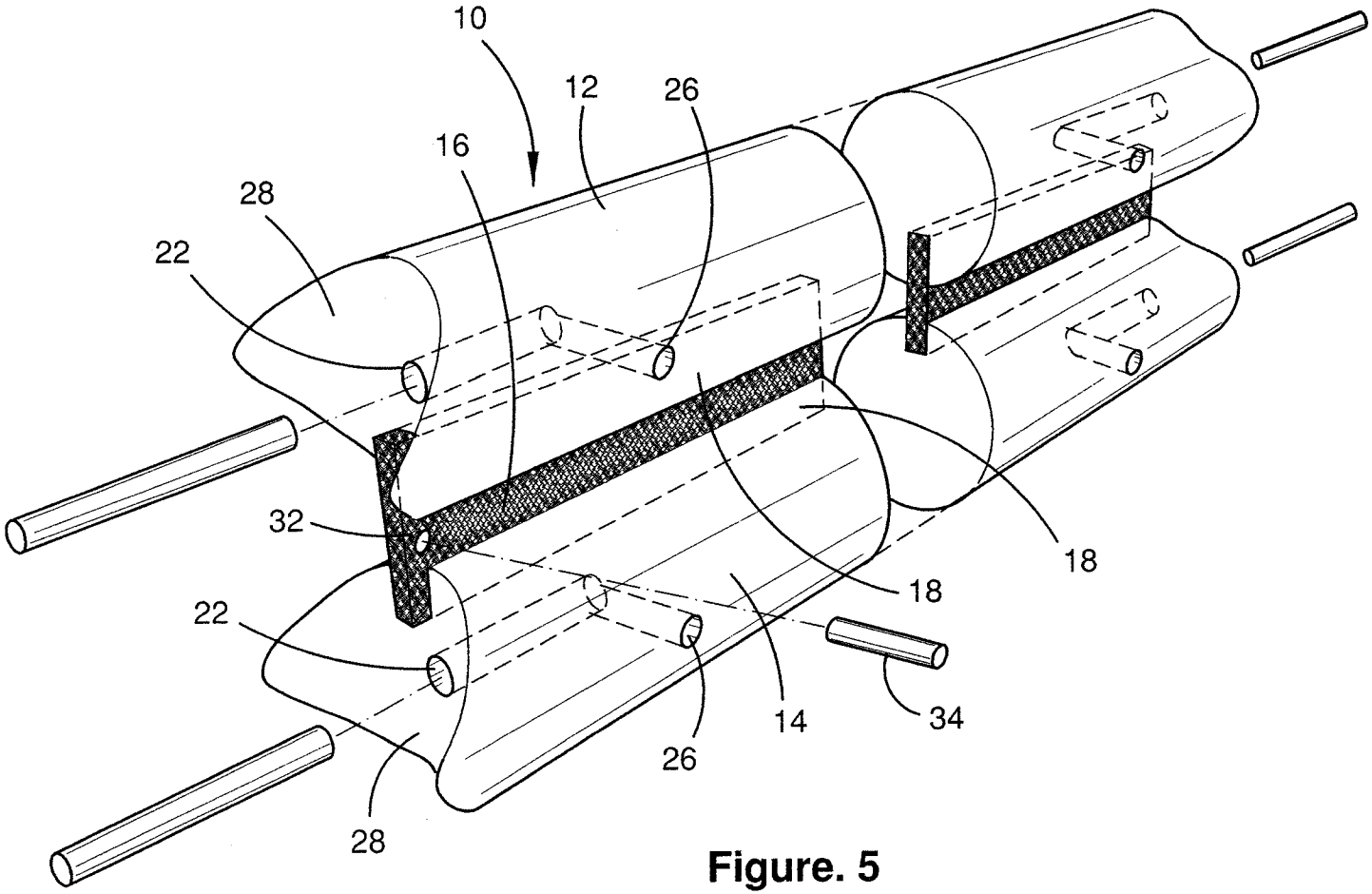
FIG. 5 shows a perspective view of an alternative embodiment of a timber joist in accordance with the present invention.
Figure 6:
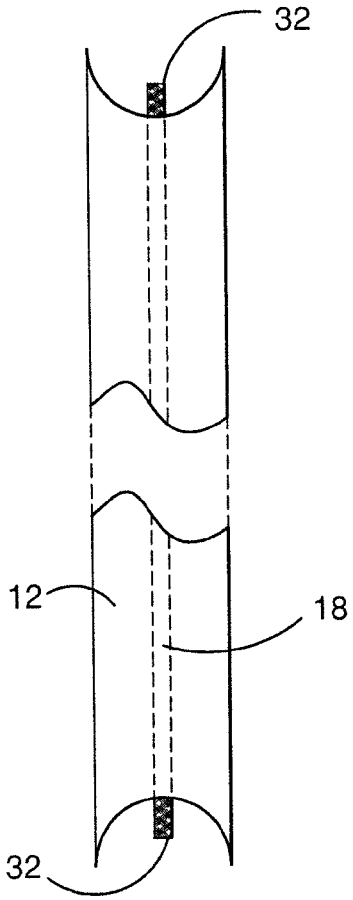
FIG. 6 shows a top view of the timber joist shown in FIG. 5.
Figure 7:
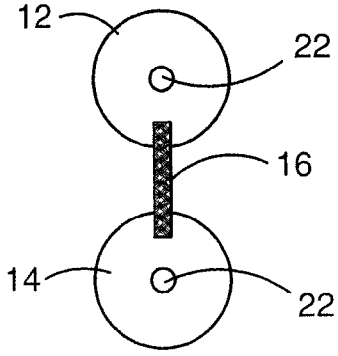
FIG. 7 shows a front view of the timber joist shown in FIG. 5.
Figure 8:
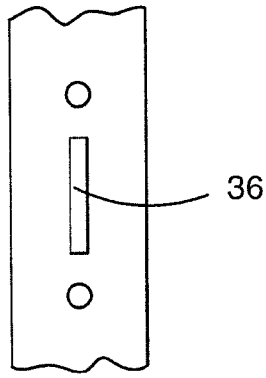
FIG. 8 shows an end view of the timber joist shown in FIG. 5.
Figure 9:
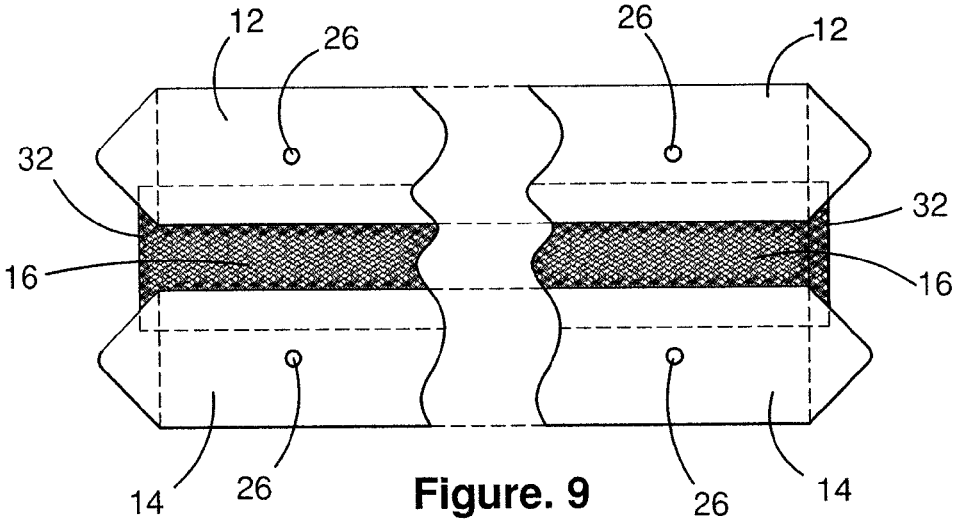

Referring initially to FIGS. 1 to 4, a timber joist 10 in accordance with an embodiment of the invention is shown. The joist 10 comprises a first flange 12 and a second flange 14 which are joined together by a web 16 such that the two flanges 12 and 14 are aligned and parallel with each other and are spaced apart from each other by a predetermined distance. The diameter of the flanges 12 and 14 and the dimensions of the web 16 are selected so that the structural strength of the combined joist will meet predetermined design and load bearing requirements. The flanges 12 and 14 are comprised of timber poles.

As is shown, each of the flanges 12 and 14 has a rectangular groove or slot 18 cut therein into which the web 16 is located in a relatively close sliding fit. A suitable bonding material or other fixing means is used to secure the web 16 into the slots 18 to thereby ensure that the joist acts in a structurally integral manner. The bonding material that is used to bond the web 16 into the slots 18 will depend on the material from which the web 16 is formed. Typically a resin based waterproof structural adhesive will be appropriate.

In the preferred form of the invention, the web 16 is formed of a plywood or plywood like material which is well known in the art, and the bonding material selected will be of a type such that a high strength timber to timber bond is achieved between the web 16 and the timber from which the flanges 12 and 14 are made. If necessary, the composite joist may be treated after assembly to ensure that the web to flange bond is of high strength.

As mentioned, the flanges 12 and 14 are both formed of timber poles. Timber poles are selected because of the significant advantages that timber poles provide. A number of advantages which are inherent in the use of timber poles and are not to be found with other timber products such as sawn timber or laminated timber products. One significant advantage, for example, is that timber poles are relatively inexpensive and are manufactured simply by cutting down a suitable diameter tree and then trimming the outer surface of the tree to form a pole with a constant diameter along its full length. Only waste material such as bark and branches are cut from the outer surface of the pole.

Timber poles, sometimes called "logs" or "true rounds" are particularly strong since the natural strength of the timber fibres is not disrupted by sawing or other treatment. The integrity of the pole is maintained, and the trimming process required to circularise the pole will not greatly affect the overall strength of the pole. Also, it will be appreciated that the core of the pole, which is relatively structurally weak, is kept at the centre of the pole where, under load conditions, the stresses on the pole will be less than the stresses at the periphery of the pole.

It will be appreciated that the natural characteristics of timber are that the central core or pith of the pole is relatively soft and has low structural strength. The periphery of the pole, on the other hand, is much harder and the timber fibres are able to carry a high load. Also, this strong outer layer is more resistant to water absorption and thus by keeping the outer circumference of the timber pole intact, the structural integrity of the pole is maintained.

In addition to the benefits gained by use of timber poles, the joist (once assembled) acts as a composite member which serves to provides further structural strength and stability.

Thus, forming a structural member out of timber poles has a number of advantages, including relatively low waste, and maintaining the structural integrity of the round timber pole.

The overall height of the joist can be controlled by ensuring that timber poles of constant diameter are used, and that the slots 18 cut in the poles are of constant depth to accommodate standard dimension webs. Alternatively, if the diameters of the poles are variable to some degree, that variation can be accommodated by changing the depth of the slots 18 to ensure that the overall height dimension of the joist is constant. This will ensure that where the joists are used, for example, as supports for a deck or floor, the deck or floor is planar and all components of the deck or floor are supported by adjacent joists.

An alternative option is to cut a flat face, as indicated by dotted lines 20 into the top and bottom of the joist, with the faces 20 being a preselected distance apart from each other. This will ensure the joist has a flat bearing face on which cross members can be seated, and also ensures that the overall height of the joist can be precisely controlled.

Connection of the joist to any desired structure can conveniently be achieved by providing a pair of dowel type connections at each end of the joist. As shown in FIG. 1, each of the flanges 12 and 14 have had an axially central bore 22 machined into the end thereof to a predetermined depth. This bore 22 is dimensioned to receive a steel dowel 24 as shown. As will be appreciated, the axial bore 22 not only provides for a strong attachment means (as described below), it also removes the central weakest part of the pole flanges 12 and 14 thereby providing enhanced strength/structural integrity to the joist as a whole.

A lateral access bore 26 connects the end of the bore 22 to a location exterior of the pole and this lateral access bore 26 is used to inject a suitable adhesive bonding material into the bore 22 in order to bond the dowel 24 into the bore 22. Generally the bore 22 will be of slightly larger diameter than the dowel 24 so that the bonding material injected through the access bore 26 will fully surround the dowel 24, thereby ensuring a high strength bonded connection between the dowel 24 and the flange 12 or 14. A dowel centring ring, shown by dotted lines 29, may be placed at the opening of bore 22 for axially centring the dowel 24. In this configuration the dowel 24 is received through the ring into the bore 22 and the inner diameter of the centring ring matches substantially to the diameter of the dowel 24 to enable a secure fit. The dowel centring ring may be made from plastic, metal or composite materials, or the like. The centring ring may comprise of lugs on the external diameter for secure placement of the ring to the opening of bore 22. The centring ring 29 may be used to create a sealing face between the end 28 of the pole, and the pole or other structural component to which the joist is mounted, thereby ensuring a sealed continuous passage for bonding material injected into passage 26.

The adhesive bonding material may comprise a two component epoxy material or in some applications a single phase resin may be used. Generally the adhesive will completely encase the dowel, thereby providing a barrier to corrosion of the dowel along its entire length.

By axially securing each of the flanges 12 and 14 of the joist all load forces experienced by the joist are transmitted axially through the flanges 12 and 14. This again serves to add to the strength of the connection and any construction erected using the joist.

Further, by housing the dowel 24 inside the flange 12 or 14 the dowel 24 is protected from fire. Other known joining systems make use of connectors (e.g. pins, nails, bolts, plates etc) which are externally fitted. In the event of a fire, such externally fitted connectors have been found to transfer heat into the timber of the joist resulting in charring of the adjoining timber and consequential joint failure.

By providing internal dowel connectors 24 this problem is avoided, and the fire rating of the resulting joist is dependent on the web and flanges 12 and 14 of the joist. It is further noted that the round flanges 12 and 14 of the preferred embodiment of the invention are have a lesser tendency to support a flame than sawn timber as is used in traditional joists.

In use it is envisaged that the opposite end 25 of the dowel 24 will pass through a vertical post or the like which will have a similar bonding arrangement to ensure that both ends of the dowel are properly anchored in their respective bores.

Since two dowels 24 are provided, one for each of the flanges 12 and 14, the joist 10 will be held vertical by the two dowels 24, preventing twisting of the joist as load is applied to the joist in use. Additionally, by securing both flanges 12 and 14 of the joist 10 (by dowels 24) potential rotation of an individual flange 12 or 14 under load is reduced. Obviously both ends of the joist will be mounted in this fashion, thereby ensuring that four high strength dowels 24 are used to secure the joist in position. Hot dipped galvanised deformed reinforcement bars may be used, or other suitable alternatives may be considered, depending on strength requirements and environmental conditions.

Where the joist is to be connected to a vertically extending circular pole, or the like, the ends 28 of the flanges 12 and 14 may be formed having a scalloped concave shape as indicated at numeral 30. The radius of curvature of this concave shape 30 will be selected to mirror the diameter of the vertical pole to which the joist is to be connected, thereby ensuring a neat and structurally sound connection with a vertical pole of this type. It will, of course, be appreciated that the ends 28 of the flanges 12 and 14 may be formed with a scalloped concave shape 30 oriented so as to connect with a circular pole of any orientation. For example, a vertical radial cut (as opposed to the horizontal radial cut as depicted) could be made to form a scalloped concave shape suitable for use with a horizontally extending circular pole.

The vertical member to which the joist is connected can itself be a joist of the type described herein. In other words, joists of the type shown in FIG. 1 can be placed at angles to each other to form, for example, a portal frame or like structure. The joist shown in FIG. 1 can thus be used either horizontally, or vertically, or indeed in any orientation, and the term "joist" is not intended to limit in any way the application to which the structural member of the invention can be put.

To improve the strength of the end connections of the joist with vertical support to which the joist is to be connected, the web 16 may be extended beyond the end of the flanges, as depicted in FIGS. 5 to 9 of the drawings. As shown, the web 16 has a tongue 32 which extends beyond the end face 28 of the flanges, and that tongue 32 will be slotted into a vertically extending groove 36 in the end support. The tongue 32 will be bonded with the suitable adhesive material into the vertically extending groove to thereby strengthen the integrity of the end connection and furthermore prevent twisting of the joist as load is applied to the joist in use. Since the web 16 can be made of relatively high strength material this end connection can be made to be operatively high strength, further improving the overall structural strength of the structure into which the joist is incorporated. If necessary, a laterally extending pin as indicated by dotted lines 34 can be used to laterally pin the tongue 32 to the vertical support.

It will be appreciated that the scalloped ends 28 of the flanges act in conjunction with vertical posts to which the joists are connected to prevent the joists twisting under load. Thus, the combined effect of a shaped and nested interconnection between post and joist, and the dual dowel connection at each end of the joist will ensure that the end connection of the joist is structurally sound.

Figure 10:
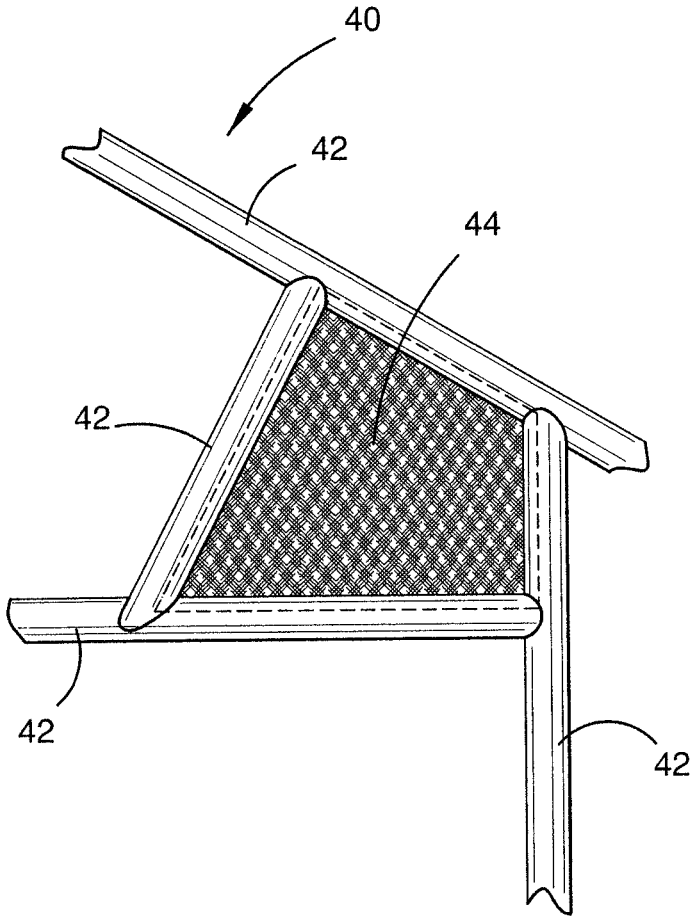
FIG. 10 shows a side view of one embodiment of a truss which incorporates the flange and web construct of the invention.

Whilst it is envisaged that a joist of the type shown in FIGS. 1 to 9 will be the preferred form of structural member with which the invention will be used, other forms of structural members are possible. FIG. 10 depicts one such additional example. The example shown comprises a connection 40 formed of a series of timber poles 42 connected together to form a truss. A web member 44 has been bonded into one of the polygon shaped gaps between the poles 42, and bonded with a slot and tongue type connection arrangement as discussed previously with respect to the flange and web arrangements of the joist shown in FIGS. 1 to 9. By bonding the web into the polygonal shaped space in this manner will ensure that the overall strength of the truss is significantly improved, particularly where a relatively high strength web material, such as plywood, is used.

As mentioned previously, the web material can be formed of any suitable material and the strength and thickness of the web will depend on the overall strength requirements of the joist, the diameters of the log, and like considerations. Clearly, if a high strength web is required, a thicker plywood material, for example, may be used. Other web materials might comprise fibrous cement or like material, or other high strength planar materials such as chipboard, particle board, and plastics type materials.

Various species of timber would be suitable to form the timber poles, particularly those type of species that tend to have a relatively constant diameter for a considerable portion of their length to minimise waste during the trimming and circularising processes referred to previously. Plantation pine materials tend to form suitable true rounds. Other materials that might be considered, for example, include coconut, Douglas fir, and various eucalypt species. In some applications, high strength bamboo poles might be considered.

The timber poles will typically be treated against insect damage and fungus and might be impregnated with various timber protection products and/or fire retardants.

As mentioned above, the joists described herein can be used in many different applications and in particular, the joists will be suitable for use as columns of a structure in which case the lower ends of the columns might either be embedded in concrete or supported on studs which in turn are embedded in concrete foundations.

It will be appreciated that the dowel type connection described herein is advantageous since it transfers connection loads directly along the central axis of the timber pole. The bore hole along the core of the timber pole serves to remove only the weakest portion of the timber pole. Also, the scalloped end of the poles serve to increase the bearing surface area of the pole ends, thereby ensuring a well supported transfer of loads between different components within the structure.

As described above, one advantage of the dowel type construction referred to herein is that all metal components are encased within timber components in the manner described herein. That arrangement not only provides an aesthetically attractive connection arrangement, but also is advantageous in that the metal components, in the event of a fire, are not directly exposed to the heat of the fire thus avoiding catastrophic collapse of the structure shortly after the outbreak of a fire.

Figure 11:
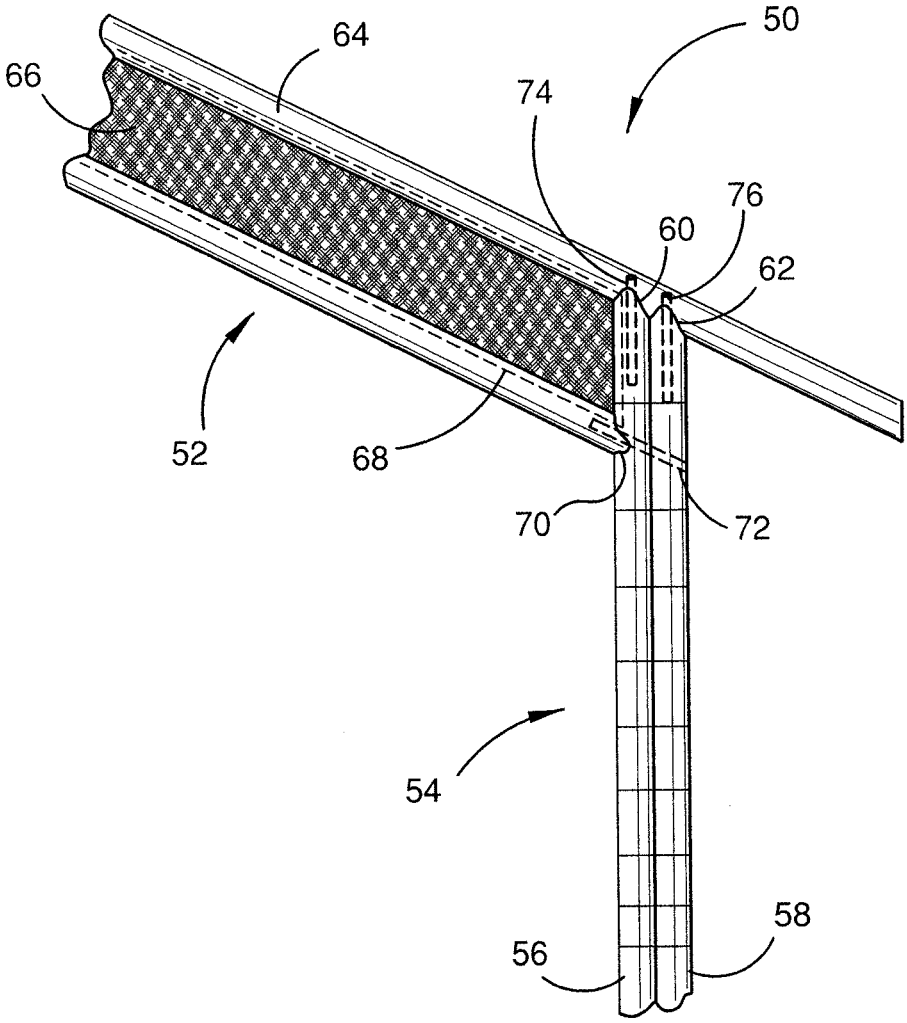
FIG. 11 shows a side view of an elbow joint including a timber joist in accordance with an embodiment of the invention.

FIG. 11 provides a view of an elbow joint 50 constructed using a joist 52 as described above and a structural member 54.

The structural member in this instance includes a pair of poles 56 and 58 joined together, each pole having a radial cut 60, 62 in its end. The joist 52 has been manufactured such that the upper flange 64 extends beyond the web 66 and lower flange 68. The radial cut 70 in the end of the lower flange 68 has been made at an angle which accommodates the angle at which the lower flange 68 abuts the pole 56 of the structural member 54. Similarly, radial cuts 60 and 62 in the poles 56 and 58 of the structural member 54 have also been made to accommodate the angle of the upper flange 64 of the joist 52.

Connection between the joist 52 and the structural member 54 is provided by a combination of: the seating of the pole 56 of the structural member 54 in the radial cut 70 of the lower joist flange 68; the seating of the upper flange 64 of the joist 52 in the radial cuts 60 and 62 of the poles 56 and 58 of the structural member 54; the insertion of the dowel 72 of the lower flange 68 of the joist 52 through the poles 56 and 58 of the structural member 54; the insertion of the dowels 74 and 76 of the poles 56 and 68 of the structural member 54 through the upper flange 64 of the joist 52.

It will be understood that the invention disclosed and defined in this specification extends to all alternative combinations of two or more of the individual features mentioned or evident from the text or drawings. All of these different combinations constitute various alternative aspects of the invention.

It will also be understood that the term comprises (and grammatical variants thereof) as used herein is equivalent to the term includes and should not be taken as precluding the existence of additional elements or features.

The invention claimed is:

1. A timber joist comprising:

first and second flanges connected together by a web, the first and second flanges each having respective facing surfaces facing each other and each having a respective slot formed therein that extends longitudinally along a length of the flange and that is dimensioned so as to receive the web therein, the web extending into and being bonded in the slots of the first and second flanges so as to be structurally integral with the flanges, and such that the web, the first flange, and the second flange act together as a composite structural member, wherein each flange comprises a timber pole having a central axis, a diameter, and opposite ends, said timber poles each being a naturally-occurring round cross-section pole having a central core and a peripheral surface trimmed so that the pole has a substantially constant cross-sectional shape over a total length thereof;

wherein at least one end of one of the flanges has an axial bore extending along at least part of the central axis of the flange, the axial bore being sized to receive a dowel and configured to form a load-bearing dowel connection therewith, wherein the facing surfaces of the first and second flanges have substantially curved profiles, and wherein the web has a height greater than the diameter of the first or second flange.

2. A timber joist according to claim 1, and further comprising a dowel member received in the axial bore, wherein the dowel member is a reinforcement bar.

3. A timber joist according to claim 2, and further including a centering ring located at a mouth of the axial bore, and wherein the dowel member is received through the centering ring into the axial bore.

4. A timber joist according to claim 3, wherein the dowel member is bonded into the axial bore by an adhesive material, and wherein the centering ring axially centers the dowel member and prevents the dowel member from contacting an internal surface of the axial bore, the adhesive material completely encasing the dowel member within the axial bore.

5. A timber joist according to claim 4, wherein the at least one flange having the axial bore also has a lateral access bore extending from an external surface of the flange and intersecting the axial bore, the lateral access bore being configured to permit injection of an adhesive material into the axial bore so as to bond the dowel member in place in the axial bore, and wherein the lateral access bore is between the ends of the flange.

6. A timber joist according to claim 1, wherein at least one end of one of the flanges is provided with a radial cut shaped and positioned to engage with a further timber pole.

7. A timber joist according to claim 1, wherein the web is generally planar.

8. A timber joist according to claim 1, wherein the opposite ends of one of the flanges define opposite innermost faces, and wherein the web extends between the opposite innermost faces and has a length equal to a distance between the innermost faces.

9. A timber joist according to claim 1, wherein the opposite ends of one of the flanges define opposite innermost faces, and wherein the web is longer than a distance between the opposite innermost faces.

10. A timber joist according to claim 1, wherein the web is shorter than the total length of the flanges.

11. A timber joist according to claim 1, wherein the web comprises one or more segments and the flanges include one or more slots, and wherein each web segment connects into one of the corresponding slots in the flanges.

12. A timber joist according to claim 1, wherein the web is formed of a material selected from a group including: processed timber; chipboard, plywood, metal sheet, metal plate, fibre reinforced cement sheet, plastic, and fibre reinforced plastic material.

13. A timber joist according to claim 1, wherein the flanges are parallel to each other and the web is of elongate rectangular shape.

14. A timber joist according to claim 1, wherein each flange includes an axial bore at each of its opposite ends.

15. A timber joist according to claim 1, wherein the web separates the first flange from the second flange by a distance greater than the diameter of the first or second flange.

16. A timber joist according to claim 1, wherein the at least one flange having the axial bore also has a lateral access bore extending from an external surface of the flange and intersecting the axial bore, the lateral access bore being configured to permit injection of an adhesive material into the axial bore so as to bond the dowel member in place in the axial bore, and wherein the lateral access bore is between the ends of the flange.

17. A timber joist according to claim 1, wherein adjacent ends of the first and second flanges are each provided with a vertically-oriented radial cut.

18. A timber joist according to claim 1, wherein adjacent ends of the first and second flanges are each provided with a horizontally-oriented radial cut.

19. A timber joist according to claim 1, wherein at least one of the flanges is provided with a flat bearing face opposite the slot, the flat bearing face being configured to support one or more cross members.

20. The timber joist according to claim 19, wherein the flat bearing face extends the total length of the flange.

21. A structure comprising a plurality of interconnected structural members, wherein one or more of the structural members is a timber joist according to claim 1.

* * * * *